United States Patent [19]

Towner et al.

[11] Patent Number: 4,829,961

[45] Date of Patent: May 16, 1989

[54] LINKAGE FOR ACTIVATING THROTTLE AND SPARK ADVANCE

[75] Inventors: Stephen J. Towner, Libertyville; Robert L. Turk, Waukegan, both of Ill.

[73] Assignee: Outboard Marine Corporation, Waukegan, Ill.

[21] Appl. No.: 136,737

[22] Filed: Dec. 21, 1987

[51] Int. Cl.[4] ..... F02D 5/02; F02D 31/00

[52] U.S. Cl. ..... 123/413; 123/400

[58] Field of Search ..... 123/413, 400, 361, 403

[56] References Cited

U.S. PATENT DOCUMENTS

| | | | |
|---|---|---|---|
| 2,906,251 | 9/1959 | Sodor, Jr. | 123/413 |
| 3,721,223 | 3/1973 | Randan et al. | 123/413 |
| 4,071,002 | 1/1978 | Frahin | 123/413 |
| 4,528,953 | 7/1985 | Flaig et al. | 123/413 |
| 4,528,954 | 7/1985 | Slattary | 123/413 |
| 4,566,415 | 1/1986 | Iwai et al. | 123/413 |
| 4,606,314 | 8/1986 | Yamazaki | 123/413 |
| 4,622,938 | 11/1986 | Wenstadt et al. | 123/413 |
| 4,703,731 | 11/1987 | Clark et al. | 123/413 |

FOREIGN PATENT DOCUMENTS

| | | |
|---|---|---|
| 59-99064 | 6/1984 | Japan . |
| 410420 | 5/1934 | United Kingdom . |
| 975079 | 11/1964 | United Kingdom . |

*Primary Examiner*—Raymond A. Nelli

*Attorney, Agent, or Firm*—Michael, Best & Friedrich; Michael, Best & Friedrich

[57] ABSTRACT

This invention provides a control for regulating the throttle and spark timing of a spark ignition internal combustion engine having an operator controlled device, a fuel/air mixing device, and a spark timing device. The control comprises a support, a throttle control member adapted to be connected to the operator controlled device and mounted on the support for rotation about a first axis, which throttle control member is adapted for controlling the fuel/air mixing device, a spark control member mounted on the support for rotation about the first axis, means for adjustably fixing the spark control member to the throttle control member for common rotation, a spark lever mounted on the support for rotation about a second axis parallel to the first axis, which spark lever is adapted to be connected to the spark timing device, and a cam slot and follower arrangement on the spark lever and on the spark control member for displacing the spark lever during only a portion of the rotation of the spark control member.

19 Claims, 2 Drawing Sheets

LINKAGE FOR ACTIVATING THROTTLE AND SPARK ADVANCE

FIELD OF THE INVENTION

The invention relates generally to internal combustion engines, and especially those found in marine propulsion devices, and more particularly, to throttle and spark advance controls for such engines.

BACKGROUND OF THE INVENTION

While the invention disclosed herein has application to all forms of internal combustion engines, it is especially adaptable for use on a marine propulsion device such as an outboard motor, and especially a two stroke cycle outboard motor having a throttle and spark advance operated from a twist grip on a tiller. In motors of this type, the twist grip on the end of the tiller is rotated about the axis of the tiller to advance or retard the throttle and spark timing by means of a suitable linkage. Manufacturing tolerances dictate that the linkage be adjustable from engine to engine so that each engine can be set up to achieve optimum performance.

Engines of this type have generally been constructed with various biasing means such as springs which bias the linkage to an idle condition. Such biasing means must be overcome to open the throttle and advance the spark. Moreover, it is generally preferred in two cycle engines that this linkage generally accommodate simultaneous movement of both the throttle and spark timing plate through a portion of the range of motion from idle to full throttle, then hold the spark timing constant while the throttle is further opened. One prior method of accomplishing this motion was by spring loading the spark advance and extending this spring to allow further motion of the throttle while holding the spark timing constant. Previous attempts to reduce the number of springs in linkages of this type have lead to problems in manufacture and adjustability.

It can be appreciated that overcoming these springs, especially the spark advance spring, can quickly fatigue the wrist of an operator. Thus, it is desirable to have an adjustable linkage which can control throttle and spark advance while overcoming a minimum to biasing means.

Attention is directed to the following patents:

| U.S. Pat. Nos. | |
|---|---|
| 3,721,223 | 4,566,415 |
| 4,071,002 | 4,606,314 |
| 4,528,954 | |
| JAPANESE REFERENCE | |
| 99,064JA | |
| BRITISH REFERENCE | |
| 410,420Br. | |
| 975,079Br. | |

SUMMARY OF THE INVENTION

This invention provides a control for regulating the throttle of a fuel/air mixing device and the spark timing of a spark timing device included in an internal combustion engine having an operator controlled device. The control comprises a support, a throttle control member adapted to be connected to the operator controlled device and mounted on the support for rotation about a first axis, the throttle control member including means adapted for controlling the fuel/air mixing device, a spark control member mounted on the support for rotation about the first axis, means for adjustably fixing the spark control member to the throttle control member for common rotation, a spark lever mounted on the support for rotation about a second axis parallel to the first axis, the spark lever being adapted to be connected to the spark timing device, and means on the spark lever and on the spark control member for displacing the spark lever during only a portion of the rotation of the spark control member.

In one embodiment of the invention, the means adapted for controlling the fuel/air mixing device comprises a cam surface on the throttle control member and further includes a cam follower biased into engagement with the cam surface.

In one embodiment of the invention, the control further includes a carburetor which includes a throttle plate and which constitutes the fuel/air mixing device, and means for biasing the throttle plate to a closed position. The throttle plate biasing means also biases the throttle cam follower into engagement with the throttle cam.

In one embodiment of the invention, the means for adjustably fixing the throttle control member to the spark control member comprises an arm extending laterally from one of the control members and into overlying relation to the other of the control members, and means for fixing the arm to the other control member.

In one embodiment of the invention, the means for displacing the spark lever during only a portion of the rotation of the spark control member comprises a cam slot in one of the control member and spark lever, and a cam follower on the other of the spark control member and the spark lever, and received in the cam slot.

The invention also provides a control for regulating the throttle of a fuel/air mixing device and the spark timing of a spark timing device included in an internal combustion engine. This control comprises a support, a throttle control member mounted on the support for rotation of about a first axis, the throttle control member including a means adapted for controlling the fuel/air mixing device, a spark control member mounted on the support for rotation about the first axis in unison with the throttle control member, a spark lever mounted on the support for rotation about a second axis parallel to the first axis, the spark lever being adapted to be connected to the spark timing device, means on the spark lever and on the spark control member for displacing the spark lever during only a portion of the rotation of the spark control member, an operator controlled lever mounted on the support for rotation about a third axis perpendicular to the first and second axes, and means for causing rotation of the throttle control lever about the first axis in response to rotation of the operator controlled lever about the third axis.

In one embodiment of the invention, the means for causing rotation of the throttle control lever comprises a link having a first end pivotally connected to the operator controlled lever, and a second end pivotally connected to the throttle control member.

In one embodiment of the invention, the pivotal connection at one end has a horizontal axis and the pivotal connection at the second end has a vertical axis.

In one embodiment of the invention, the support is an engine including a crankcase having a top wherein the first and the second axes are vertical and wherein the throttle control member, the spark control member, and the spark lever are mounted on the top of the crankcase.

In one embodiment of the invention, the crankcase includes a side, wherein the third axis is horizontal, and wherein the operator controlled lever is mounted on the side of the crankcase.

A primary feature of the invention is the provision of a throttle and spark advance linkage wherein the only biasing means that must be overcome by the operator to open the throttle and advance the spark is the means biasing the throttle plate closed.

Another primary feature of the invention is the provision of a throttle and spark advance linkage wherein the control for the spark advance is adjustably connected to the control for the throttle advance.

Another primary feature of the invention is the provision of an operator actuated control lever positioned on the side of the crankcase and pivotable about a horizontal axis and the provision of a throttle control member, a spark control member, and a spark control lever positioned on the top of the crankcase and pivotable about parallel vertical axes.

Various other features and advantages of the invention will be apparent from the following description, from the claims, and from the drawings.

Figure 1:
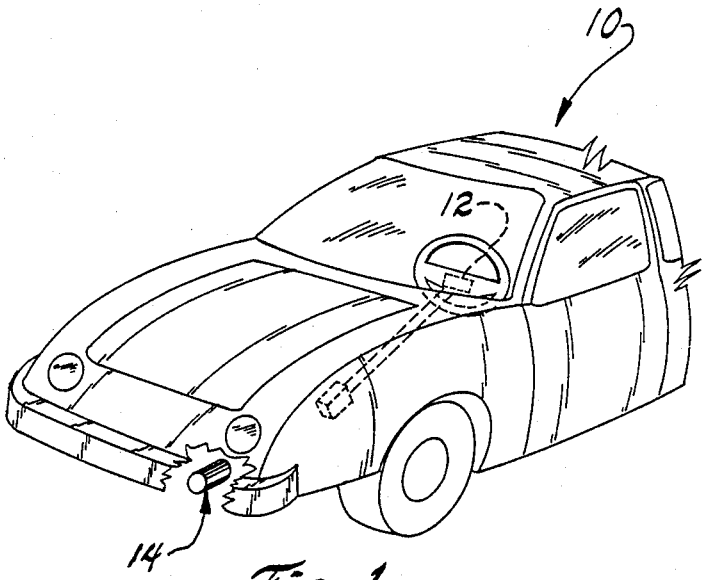
FIG. 1 is a side elevation view of an outboard motor embodying the invention.

Before describing an embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

GENERAL DESCRIPTION

Figure 2:
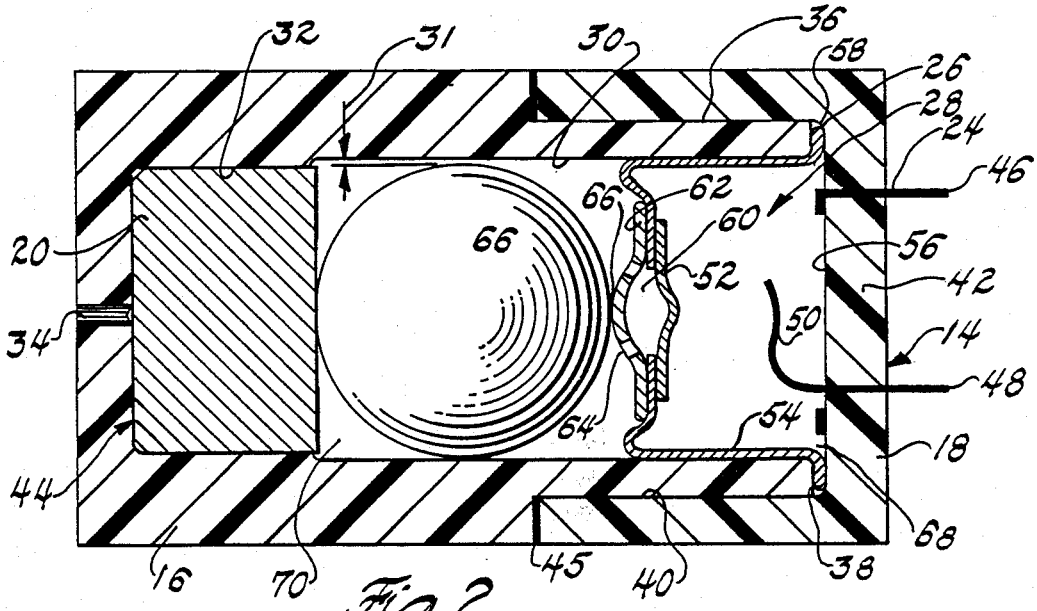
FIG. 2 is a top plan view of the motor embodying the invention.

Illustrated in FIG. 1 is a marine installation including a marine propulsion device 8. In the embodiment shown, the marine propulsion device is an outboard motor 10 including an internal combustion engine 12 mounted on a lower unit 14. The internal combustion engine 12 is drivingly connected to a propulsion means such as a propeller 16 which is rotatably mounted in the lower unit 14. The outboard motor 10 is pivotally attached to the transom 10 of a boat 20 to allow rotation of the motor 10 about a generally horizontal axis for tilting and about a generally vertical axis for steering. In preferred embodiment, as seen in FIG. 2, the internal combustion engine 12 is of a V-4 configuration.

The outboard motor 10 is clamped onto the transom 18 of the boat 20 by means of a stern or transom bracket 22 which contains a generally horizontal pin 24 which acts as the tilt axis of the motor. Also attached to the tilt pin 24 is the pivot or swivel bracket 26 through which runs a vertical pin 28 whose ends are attached to the lower unit 14 and which provides the generally vertical steering axis of the motor.

Although various suitable arrangements can be employed, in the preferred embodiment, as shown in FIG. 1, the boat is steered by means of a tiller arm 30 extending generally forwardly from the lower unit 14 of the outboard motor. One end of the tiller arm 20 is attached to the lower unit 14 of the outboard motor 10 and the other, free end comprises a twist grip or tiller handle 32 which can be grasped by the operator for controlling the pivotal movement of the motor about the generally vertical axis to direct the steering of the boat.

The twist grip or tiller handle 32 also rotates about the generally horizontal axis of the tiller 30 to control a push-pull cable 34 which activates the throttle and spark timing control linkage 36 of the internal combustion engine. This control linkage 36 will be described in detail later. At the tip of the free end of the tiller handle 32 is an emergency cut-off button 38 which, when depressed, shuts off the ignition of the internal combustion engine 12.

In the preferred embodiment, as shown in FIGS. 1 and 2, the internal combustion engine 12 of the marine propulsion device 8 is a two-stroke engine having one or more cylinders connected to a drive shaft 39. Although various means can be employed, the ignition system (not shown) is preferably a capacitor discharge system which includes magnets 56 (See FIG. 1) in a flywheel 58 and one or more trigger coils 60 (shown schematically in FIG. 2). The engine further includes a substantially hollow crankcase or engine block 40 having a top 41 and at least one side 43 and an air/fuel mixing device 42 attached to the crankcase or engine block 40. The fuel/air mixing device 42 comprises one or more carburetors 44 each having an air induction passage 46 and a rotatable throttle plate 48 to control the amount of air passing through the air induction passage 46 and entering into the crankcase 40. This throttle plate 48 is normally biased to a closed condition by biasing means such as a spring 50 to restrict the amount of air entering the air induction passage 46 to create an idle condition. The position of the throttle plate 48 relative to the air induction passage 46 is controlled by the control linkage 36, as will be set forth in more detail. The relative position of the throttle plate 48 to the control linkage 36 can be adjustably set by the set screw 52.

The engine also comprises a spark advance mechanism 54. In the preferred embodiment, this mechanism 54 is a spark timing system which includes the magnets 56 embedded in the rotating flywheel 58 and the trigger coil 60 (shown schematically) which is positioned on a spark advance collar or spark timer base 62 in close proximity to the rotating magnets 56 to generate an electrical signal when the magnets 56 pass the coil 60. The spark advance collar 62 is positioned around the drive shaft 39 between the flywheel 58 and the crankcase or engine block 40. The collar 62 is rotatable through a predetermined angular orientation to advance or retard the spark timing. As seen from above in FIG. 2, the collar 62 will rotate counterclockwise to advance the spark timing and clockwise to retard the spark timing. The spark advance collar 62 is connected to, and its position is controlled by, the control linkage 36, as will be described in more detail.

Figure 3:
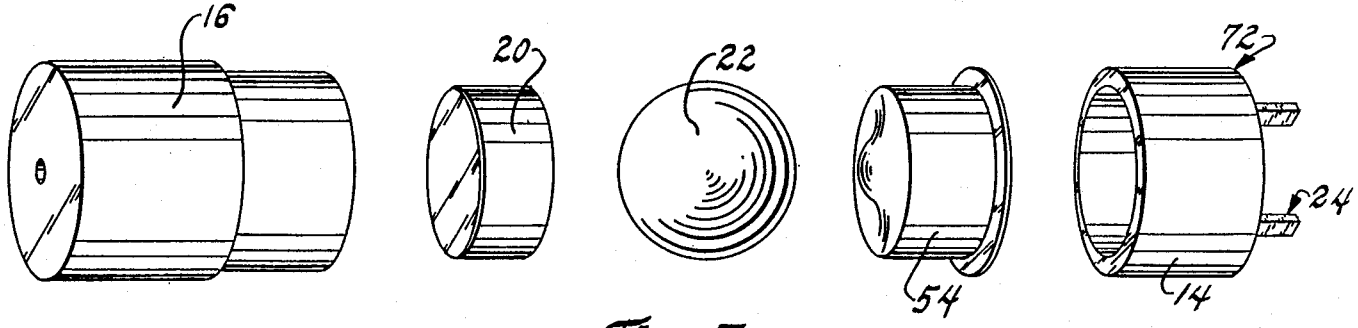
FIG. 3 is a perspective view of the control linkage embodying the invention.

Referring to FIG. 3, rotation of the tiller handle or twist grip 32 by the operator moves the inner core 66 of the push pull cable 34 which is fixed to the crankcase or engine block 40 of the outboard motor 10 by means of a bracket 70. The end 72 of the inner core 66 is attached to the lower arm 74 of an operator controlled or actuated lever 76 to control its movement. The operator controlled lever 76 is mounted approximately at its middle on the side 43 of the crankcase 40 by a pin 78 which allows the lever to rotate about a horizontal axis. By this construction, the motion of the inner core 66 is translated into rotational motion of the operator controlled lever 76. Thus, twisting of the tiller handle or twist grip 32 causes rotation of the operator controlled lever 76.

The extent of rotation of the operator controlled lever 76 is limited by a pair of adjustment screws 80 and 82 which contact fixed stops on the crankcase or engine block 40 in, respectively, the full open or idle condition.

As shown best in FIG. 2, a rigid link 84 is pivotally mounted at the top end of the upper arm 86 of the operator controlled lever 76 opposite the attachment point of the push/pull cable 34 by means of a pin 87. This link 84 connects the operator controlled lever 76 to a first end 88 of a throttle control member 90 which rotates about a pin 92 forming a first vertical axis near a second end 94 (See FIG. 3) of the throttle control member. Thus, the rotation of the operator controlled lever 76 about its horizontal axis is translated into rotation of the throttle control member 90 about its vertical axis. The link 84 is attached to the throttle control member 90 by a connecting means 96 (See FIG. 3) which generally comprises a loose fitting pin in a socket. Between the first end 88 and the second end 94 of the throttle control member 90 is a throttle cam surface 98 along which rides a throttle cam follower 100.

The throttle cam follower 100, in turn, is connected by a throttle linkage 102 to open the carburetor throttle plate 48 as the throttle control member 90 is rotated from an idle to a wide open throttle condition. In preferred embodiment, a biasing means, such as the spring 50 which biases the throttle plate to a closed position, also acts through the linkage 102, to bias the throttle cam follower 100 against the throttle cam surface 98.

Figure 4:
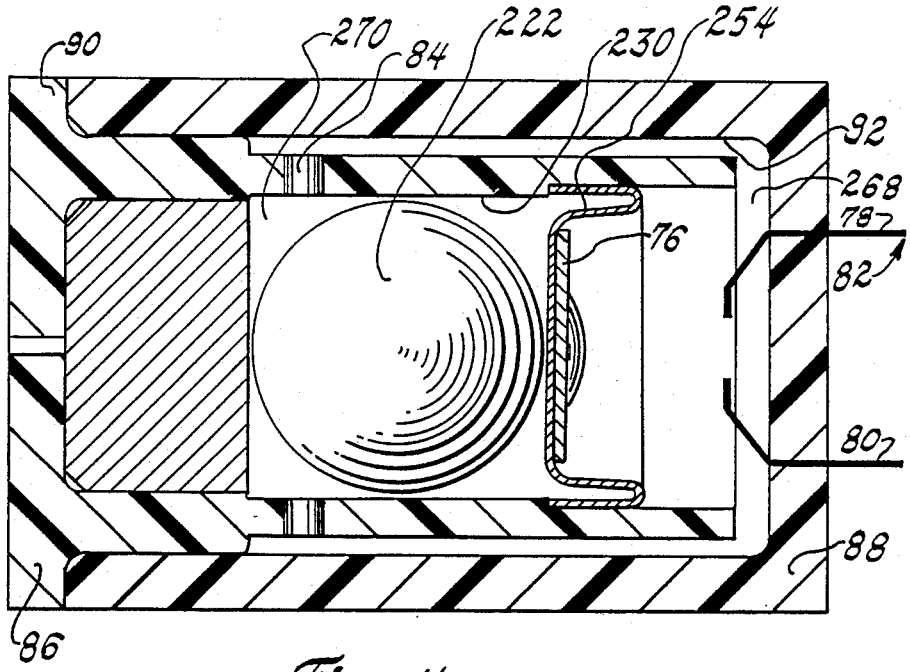
FIG. 4 is a detailed view of the spark control member and the spark lever as seen from the bottom.
Figure 5:
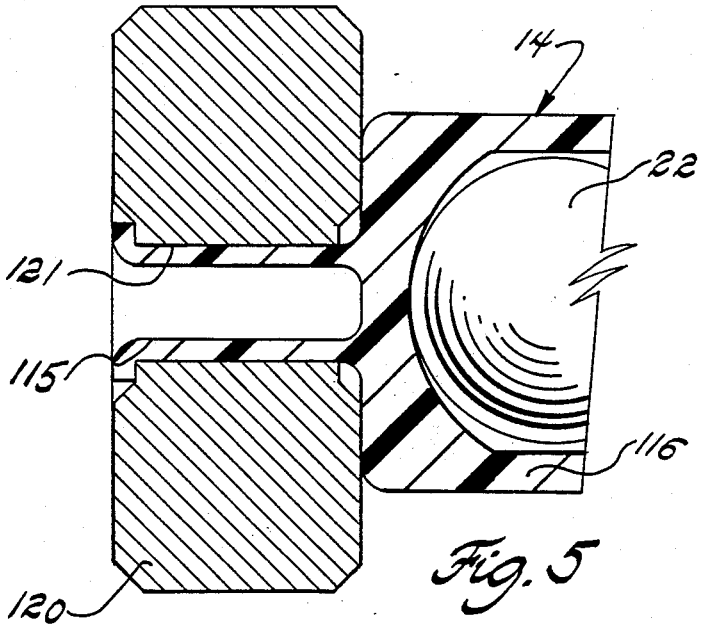
Figure 1:
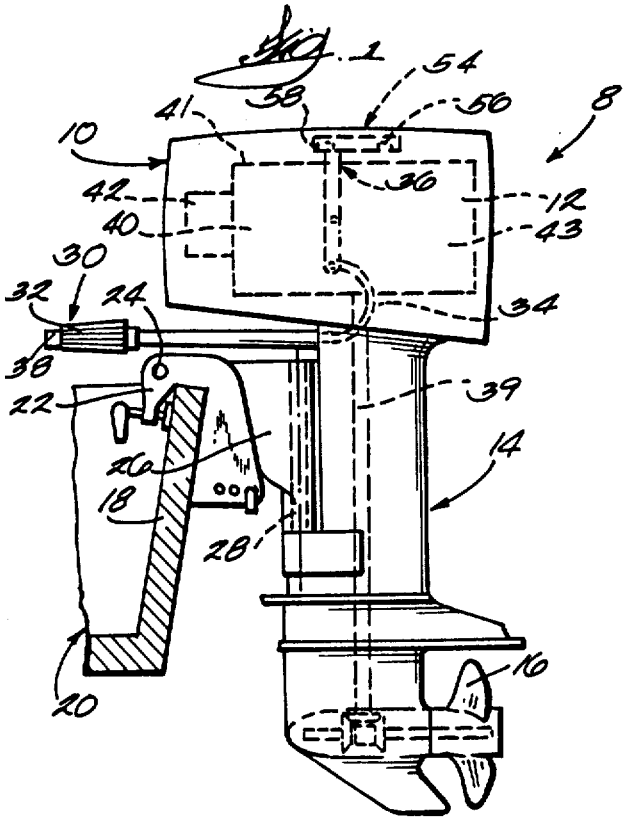
Figure 4:
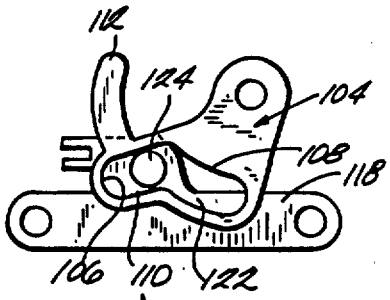
Figure 2:
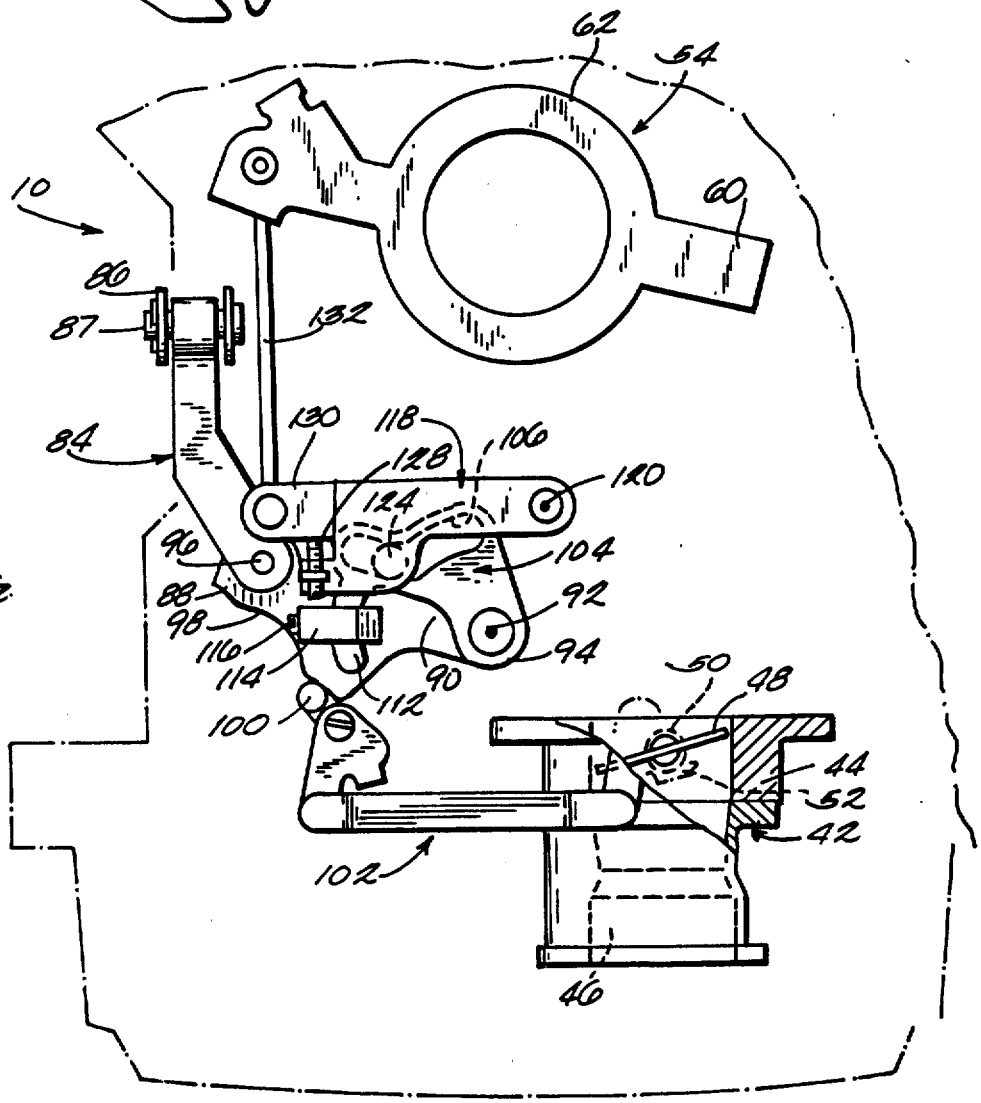
Figure 3:
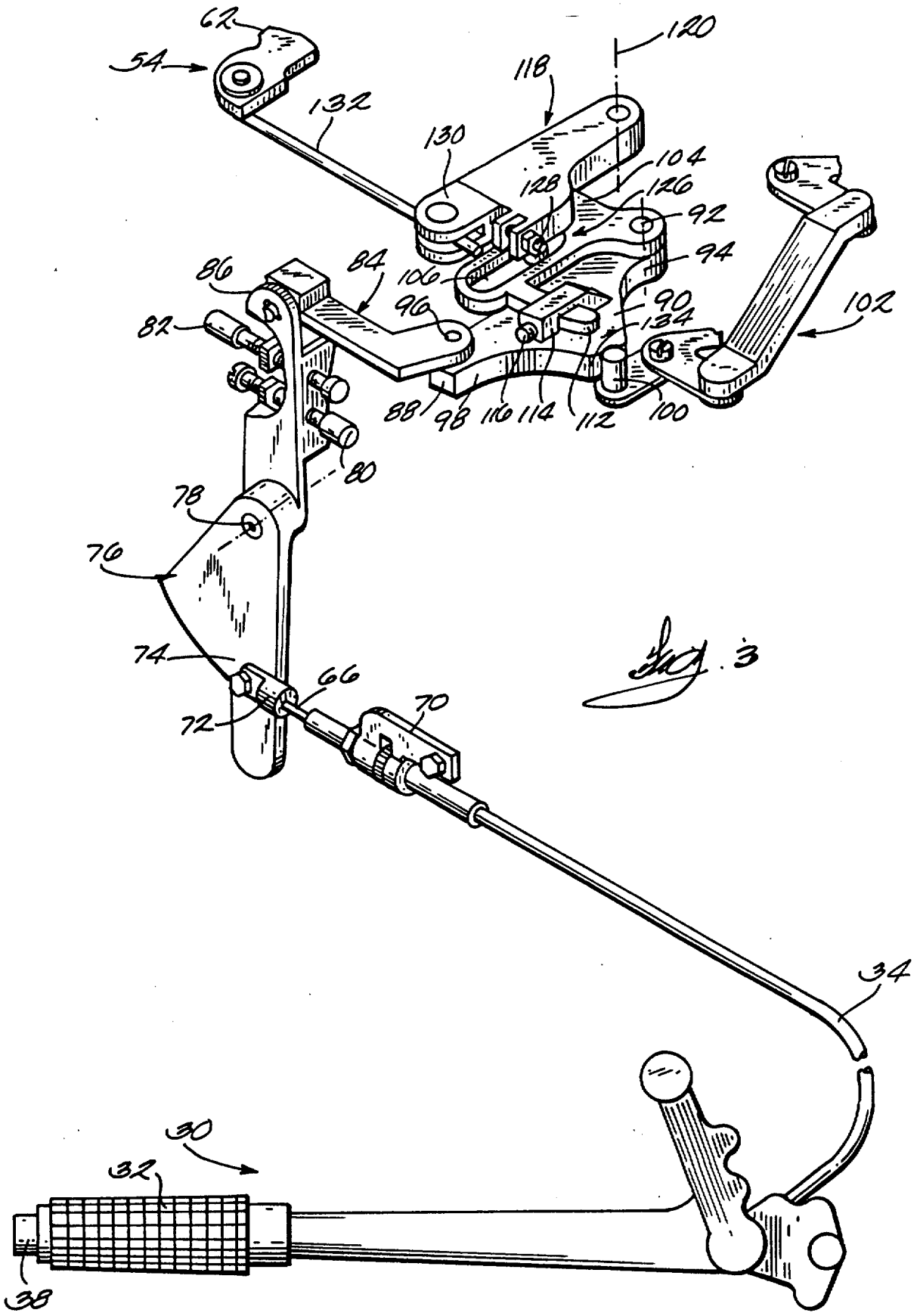

A spark control member 104 also pivots about the same first axis provided by the pin 92, partially overlies the throttle control member 90, and is adjustably fixed to the throttle control member 90. The spark control member 104 includes an enclosed cam so 106 having two opposed cam walls 108 and 110 and a laterally extending arm 112 (see FIG. 4).

While various means can be employed, in a preferred embodiment, the means for adjustably fixing the spark control member 104 to the throttle control member 90 includes the arm 112 extending laterally from the spark control member 104 in overlying relation to the throttle control member 90. The throttle control member 90 also includes a socket 114 for receipt of the arm 112 and is provided with a set screw 116. When the angular relationship between the throttle control member 90 and the spark control member 104 is determined, the set screw 116 can be screwed in to fix the arm 112 in the socket 114. Thus, rotation of one of the throttle control member 90 and the spark control 104 member will cause equal rotation of the other.

The control linkage 36 also (See FIG. 3) includes a spark lever 118 mounted on the top 41 of the crankcase or engine block 40 for rotation about a second vertical axis 120 which is parallel to the first axis provided by the pin 92. The spark lever 118 includes a portion 122 which overlies the enclosed spark cam or cam slot 106 and which includes (See FIG. 2) a depending spark cam follower 124 which is received into the cam slot 106 of the spark control member 104. The walls 108 and 110 of the enclosed spark cam or cam slot 106 are cut on two tangent radii. The slope of the cam slot and the position of the first axis provided by the pin 92 and the second axis 120 causes the spark cam slot 106 and the cam follower 124 to cooperate in allowing the spark lever 118 to rotate during only a portion of the rotation of the spark control member 104 and throttle control member 90.

The spark lever 118 is adjustably attached to the spark timing collar 62 by another link 132 which is pivotally attached to both the collar 62 and the lever 118 so that any rotation of the spark lever 118 is translated into rotation of the spark timing collar 62 to advance or retard the spark timing of the engine. The position of the spark collar 62 can be adjusted with respect to the spark lever 118 by (See FIG. 3) an adjustment means 126 comprising a screw 128 and dovetail slide assembly 130. This adjustment means 126 can be used to position the spark advance collar 62 at the proper spark advance position when the control 36 is set at wide open throttle.

As seen in FIG. 2, when the engine is in the idle condition, the throttle cam follower 100 rests against the throttle cam surface 98 and the carburetor throttle plate 48 is in the closed or idle position, cutting off a major portion of the air induction passage 46. In addition, the spark control member 104 is rotated clockwise as seen from above the engine (in FIG. 2) in order to retard the spark to obtain a slow rpm. While various arrangements can be employed, in the preferred embodiment, as the operator controlled lever 76 is rotated and the top of the upper arm 86 of the lever 76 is driven forward, the throttle control member 90 rotates counter-clockwise as seen from above (in FIG. 2). This moves the throttle cam follower 100 onto a first raised portion 134 of the cam face 98 which opens the throttle slightly. The spark control member 104 also rotates the spark lever 118 as described above to advance the timing. Once the throttle plate 48 is cracked open by the throttle cam follower 100 rolling onto the raised portion 134, the throttle plate 48 does not rotate further during the next few degrees of rotation of the throttle control member 90. The throttle cam surface 98 is designed to maintain a fairly constant slightly open condition during this period. However, the spark continues to be advanced, thus increasing the rpm of the engine 12 as the top of the operator controlled lever 76 continues to move forwardly, i.e., in the clockwise direction in FIG. 3.

At a pre-selected angular location, the orientation of the spark lever 118 and the spark control member 104 causes the spark lever 118 to stop rotation while the spark control member 104 continues to rotate. This is the point of maximum spark advance which is reached at approximately half throttle. At this point, due to the shape of the cam surface 98 on the throttle control member 90, further rotation of the throttle control member 90 causes further rotation of the throttle plate 48 to increase the engine speed, eventually to a wide open throttle condition.

By the above construction, an outboard motor 10 having a tiller arm 30 with a twist grip or tiller handle 32 can be operated with a minimum amount of effort to advance the throttle and spark timing. In the preferred embodiment, the only biasing means to be overcome is the small spring 50 tending to close the throttle plate 48. Moreover, the control linkage 36 is fully adjustable with respect to both the open and closed position of the throttle plate 48 and the timing of the spark. With respect to the throttle, the maximum and minimum openings are easily set by the adjusting screws 80 and 82 on the operator controlled lever 76 to set the throttle plate 48 at a position substantially perpendicular to and parallel to, the air induction passage 46 respectively. Once these are set, the location of the collar or spark timer base 62 can be accurately established at idle by the adjustment means 114 between the throttle control member 90 and the spark control member 104. Finally, the position of the spark advance collar or spark timer base 62 can be established by the adjustment means 126 between the spark lever 118 and the spark collar or timer base 62. However, whenever the adjustment means 126 is moved, the adjustment 114 between the throttle control member and the spark control member 104 must be re-adjusted to set the spark timing at idle condition. Thus, the control 36 can be fully adjusted for each individual motor.

Various of the features of the invention are set forth in the following claims.

We claim:

1. A control for regulating the throttle of a fuel/air mixing device and the spark timing of a spark timing device included in an internal combustion engine having an operator controlled device, said control comprising a support, a throttle control member adapted to be connected to the operator controlled device and mounted on said support for rotation about a first axis fixed relative to said support, said throttle control member including means adapted for controlling the fuel/air mixing device, a spark control member mounted on said support for rotation about said first axis independently of said throttle control member, means for angularly adjustably fixing said spark control member to said throttle control member for common rotation, a spark lever mounted on said support for rotation about a second axis parallel to said first axis, said spark lever being adapted to be connected to the spark timing device, and means on the spark lever and on the spark control member for displacing the spark lever during only a portion of the rotation of the spark control member.

2. A control as set forth in claim 1 wherein said means adapted for controlling the fuel/air mixing device comprises a cam surface on said throttle control member, and further including a cam follower biased into engagement with said cam surface.

3. A control as set forth in claim 2 and further including a carburetor which includes a throttle plate and which constitutes the fuel/air mixing device, and means for biasing said throttle plate to a closed position, said throttle plate biasing means also biasing said throttle cam follower into engagement with said throttle cam.

4. A control as set forth in claim 1 wherein said means for adjustably fixing said throttle control member to said spark control member comprises an arm extending laterally from one of said control members and into overlying relation to the other of said control members, and means for fixing said arm to said other control member.

5. A control as set forth in claim 1 wherein said means for displacing said spark lever during only a portion of the rotation of the spark control member comprises a cam slot in one of said spark control member and said spark lever, and a cam follower on the other of said spark control member and said spark lever and received in said cam slot.

6. A control as set forth in claim 1 wherein said support is an engine including a engine block having a top, wherein said first and second axes are vertical, and wherein said throttle control member, said spark control member, and said spark lever are mounted on said top of said engine block.

7. A control as set forth in claim 6 and further including an operator actuated lever mounted on said support for rotation about a third axis and constituting the operator controlled device.

8. A control as set forth in claim 7 wherein said engine block includes a side, wherein said third axis is horizontal, and wherein said operator actuated lever is mounted on said engine block side.

9. A control as set forth in claim 1 wherein said throttle control member, said spark control member, and said spark lever are made of a plastic material.

10. A control for regulating the throttle of a fuel/air mixing device and the timing of a spark timing device included in an internal combustion engine, said control comprising a support, a throttle control member mounted on said support for rotation about a first axis fixed relative to said support, said throttle control member including means adapted for controlling the fuel/air mixing device, a spark control member mounted on said support for rotation about said first axis in unison with said throttle control member, a spark lever mounted on said support for rotation about a second axis parallel to said first axis, said spark lever being adapted to be connected to the spark timing device, means on said spark lever and on said spark control member for displacing said spark lever during only a portion of the rotation of said spark control member, an operator controlled lever having one end mounted on said support for rotation of said operator controlled lever about a third axis perpendicular to said first and second axes, said operator controlled lever having a part spaced from said one end, and means connected to said part of said operator controlled lever for causing rotation of said throttle control lever about said first axis in response to rotation of said operator controlled lever about said third axis.

11. A control as set forth in claim 10 wherein said means for causing rotation of said throttle control lever comprises a link having a first end pivotally connected to said operator controlled lever, and a second end pivotally connected to said throttle control member.

12. A control as set forth in claim 11 wherein said pivotal connection at said one end has a horizontal axis and said pivotal connection at said second end has a vertical axis.

13. A control as set forth in claim 10 and also comprising means for adjustably fixing said spark control member to said throttle control member.

14. A control as set forth in claim 13 wherein said adjustable fixing means comprises an arm extending laterally from one of said control members into overlying relation to the other of said control members, and means for fixing said arm to said other control member.

15. A control as set forth in claim 14 wherein said support is an engine including a engine block having a top, wherein said first and second axes are vertical, and wherein said throttle control member, said spark control member, and said spark lever are mounted on said top of said engine block.

16. A control as set forth in claim 15 wherein said engine block includes a side, wherein said third axis is horizontal, and wherein said operator controlled control lever is mounted on said side of said engine block.

17. A control as set forth in claim 10 wherein said means adapted for controlling the fuel/air mixing device comprises a cam surface on said throttle control member, and a cam follower biased into engagement with said a cam surface.

18. A control as set forth in claim 17 and further including a carburetor which includes a throttle plate and which constitutes the fuel/air mixing device, and means for biasing said throttle plate to a closed position, said throttle plate biasing means also biasing said throttle cam follower into engagement with said throttle cam.

19. A control as set forth in claim 18 wherein said means for displacing said spark lever during only a portion of the rotation of said spark control member comprises a cam slot in one of said spark control member and said spark lever, and a cam follower on the other of said spark control member and said spark lever and received in said cam slot.

* * * * *

UNITED STATES PATENT AND TRADEMARK OFFICE

CERTIFICATE OF CORRECTION

PATENT NO. : 4,829,961

DATED : May 16, 1989

INVENTOR(S) : Stephen J. Towner et al.

It is certified that error appears in the above-identified patent and that said Letters Patent is hereby corrected as shown below:

The Title Page should be deleted to appear as per attached title page.

Figures 1 - 3 of the drawings should be deleted to be replaced with Figures 1 - 4 as shown on the attached sheets.

Signed and Sealed this

Second Day of January, 1990

*Attest:*

JEFFREY M. SAMUELS

*Attesting Officer*

*Acting Commissioner of Patents and Trademarks*

United States Patent [19]

Towner et al.

[11] Patent Number: 4,829,961

[45] Date of Patent: May 16, 1989

[54] LINKAGE FOR ACTIVATING THROTTLE AND SPARK ADVANCE

[75] Inventors: Stephen J. Towner, Libertyville; Robert L. Turk, Waukegan, both of Ill.

[73] Assignee: Outboard Marine Corporation, Waukegan, Ill.

[21] Appl. No.: 136,737

[22] Filed: Dec. 21, 1987

[51] Int. Cl.[4] ..... F02D 5/02; F02D 31/00

[52] U.S. Cl. ..... 123/413; 123/400

[58] Field of Search ..... 123/413, 400, 361, 403

[56] References Cited

U.S. PATENT DOCUMENTS

| | | | |
|---|---|---|---|
| 2,906,251 | 9/1959 | Sodor, Jr. | 123/413 |
| 3,721,223 | 3/1973 | Randan et al. | 123/413 |
| 4,071,002 | 1/1978 | Frahin | 123/413 |
| 4,528,953 | 7/1985 | Flaig et al. | 123/413 |
| 4,528,954 | 7/1985 | Slattary | 123/413 |
| 4,566,415 | 1/1986 | Iwai et al. | 123/413 |
| 4,606,314 | 8/1986 | Yamazaki | 123/413 |
| 4,622,938 | 11/1986 | Wenstadt et al. | 123/413 |
| 4,703,731 | 11/1987 | Clark et al. | 123/413 |

FOREIGN PATENT DOCUMENTS

| | | |
|---|---|---|
| 59-99064 | 6/1984 | Japan . |
| 410420 | 5/1934 | United Kingdom . |
| 975079 | 11/1964 | United Kingdom . |

*Primary Examiner*—Raymond A. Nelli

*Attorney, Agent, or Firm*—Michael, Best & Friedrich; Michael, Best & Friedrich

[57] ABSTRACT

This invention provides a control for regulating the throttle and spark timing of a spark ignition internal combustion engine having an operator controlled device, a fuel/air mixing device, and a spark timing device. The control comprises a support, a throttle control member adapted to be connected to the operator controlled device and mounted on the support for rotation about a first axis, which throttle control member is adapted for controlling the fuel/air mixing device, a spark control member mounted on the support for rotation about the first axis, means for adjustably fixing the spark control member to the throttle control member for common rotation, a spark lever mounted on the support for rotation about a second axis parallel to the first axis, which spark lever is adapted to be connected to the spark timing device, and a cam slot and follower arrangement on the spark lever and on the spark control member for displacing the spark lever during only a portion of the rotation of the spark control member.

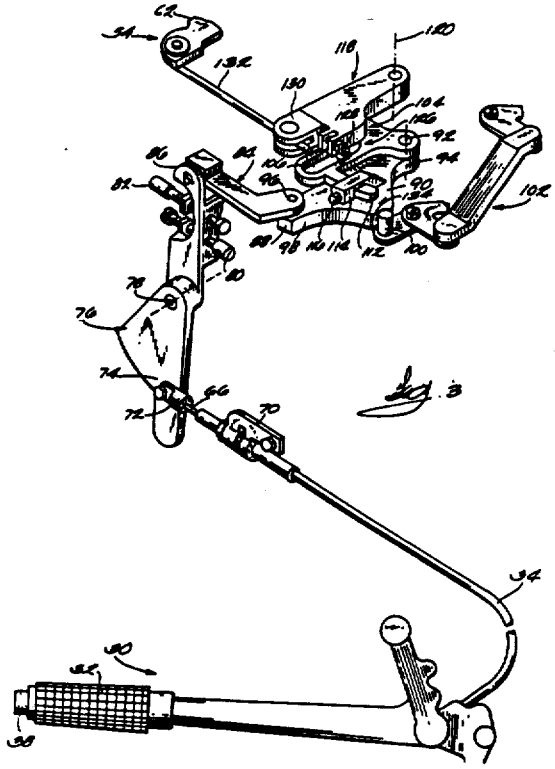

19 Claims, 2 Drawing Sheets